United States Patent [19]

Rocha Cabral et al.

[11] Patent Number: 4,630,953

[45] Date of Patent: Dec. 23, 1986

[54] PENCIL HOLDER

[76] Inventors: José E. Rocha Cabral, Avenida Tiradentes, 1595, Londrina, PR.; Oswaldo A. Correa Mellone, Rua Bandeira Paulista, 104 - Apt°. 71, Sao Paulo, both of Brazil

[21] Appl. No.: 722,143

[22] Filed: Apr. 11, 1985

[30] Foreign Application Priority Data

Jun. 29, 1984 [BR] Brazil ..... 8403212

[51] Int. Cl.[4] ..... B43K 21/06; B43K 24/04; B43K 23/00

[52] U.S. Cl. ..... 401/83; 401/84

[58] Field of Search ..... 401/82, 83, 84

[56] References Cited

U.S. PATENT DOCUMENTS

| | | | |
|---|---|---|---|
| 2,555,063 | 5/1951 | Soifer | 401/83 |
| 2,770,358 | 11/1956 | Keith | 401/83 |
| 4,352,579 | 10/1982 | Yi | 401/84 X |

FOREIGN PATENT DOCUMENTS

| | | | |
|---|---|---|---|
| 74823 | 1/1961 | France | 401/84 |
| 1340425 | 9/1963 | France | 401/82 |
| 565591 | 7/1957 | Italy | 401/84 |

*Primary Examiner*—Steven A. Bratlie

*Attorney, Agent, or Firm*—Ostrolenk, Faber, Gerb & Soffen

[57] ABSTRACT

Pencil holder, having a body or case that has on one side a slit that extends from the upper part to the lower part of the tip of the case. The slit is slotted in a manner similar to a scale and is arranged to receive a piston similar to an "L", consisting of a rod, a head interconnected by an intermediary wall, the head being placed inside the body or case and having in its center a cavity to receive the graphite. The rod runs parallel to the body and the slit and has in the middle a slit causing the formation of two sides that receive at the top, in turn, two extensions, similar to a crossbar that is arranged horizontally in relation to the rod and whose ends are sectioned to establish small lateral extensions in the form of an "L".

3 Claims, 7 Drawing Figures

PENCIL HOLDER

This invention is directed to a pencil holder inside which a graphite piece is moved by a piston connected to a driving rod.

In conventional systems, a pencil holder contains a piece of graphite in one piece, arranged at the lower end, in which the movement of this piece through an opening establishes the graphite at a length desired for use. In another more sophisticated system, the graphite is held as a piece arranged in the inside of the pencil holder and its movement is controlled by the turning of the tip of the pencil holder. Other and more complex systems have the graphite in one piece or pieces inside; but the pencil holder frequently becomes inoperative because the inside part is unable, after a certain period of use, to hold the graphite necessary for proper operation of the pencil holder, and the graphite remains inside the holder.

With the exception of the simplest model described previously, in which the graphite is held by an outside part that also serves practically as the tip of the pencil holder, all the other systems have relatively high prices, and therefore a certain preferance results for a simpler model; however, even in the systems which adopt the movement of the graphite by a part arranged on the end, this still presents, for students a relatively high price, and for this reason there still exists today a preference for a use of the pencil at much cheaper cost.

This invention has as its object a pencil holder of a cost considerably cheaper than those of the models of the common pencil holders. It presents a simple system for moving the graphite. A device which has the appearances of a pencil has an outside groove that serves for moving the piston. The graphite appears in its entirety and is of larger size than the conventional models. This also extends the life of the unit over a much longer period of time, in a manner similar to the use of a pencil.

In accordance with the invention, the pencil holder has a polygonal body in which one of its sides is equipped with a slit that goes from the upper part to the lower part of the pencil holder, said slit being grooved to limit the movement of the piston. A piston is constituted of a part similar to an "L" with an upper crossbar, said piston moving in the slit of the body of the holder and being formed by a part that is arranged in the interior of the body of the pencil holder, forming a head with lower projection where there is provided an inside cavity arranged to receive and hold the graphite, and the rod having an inside opening that goes from the upper end to a lower position that coincides with the inside head, the two upper ends arranged with two projections in the form of crossbars whose ends, in turn, are sectioned to establish small lateral extensions similar to a "U", in a manner to permit the release of these ends by simple pressure on the two respective sides and, therefore, causing the release of the piston that drops and rises by the respective grooves of the slit of the body of the holder.

The invention will be described, for better understanding, making reference to the drawings attached, shown by way of example and not as a limitation, in which.

Figure 3:
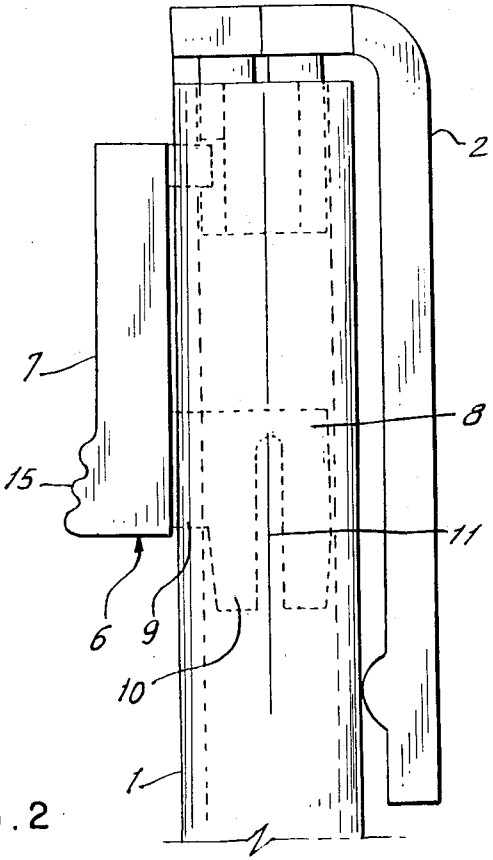
FIG. 3 is a side sectional view of the piston of the cap and its positioning on the body of the pencil holder.
Figure 2:
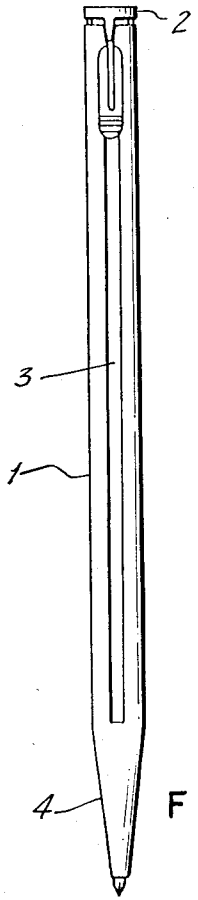
FIG. 2 is a view of the pencil holder with all its parts.
Figure 1:
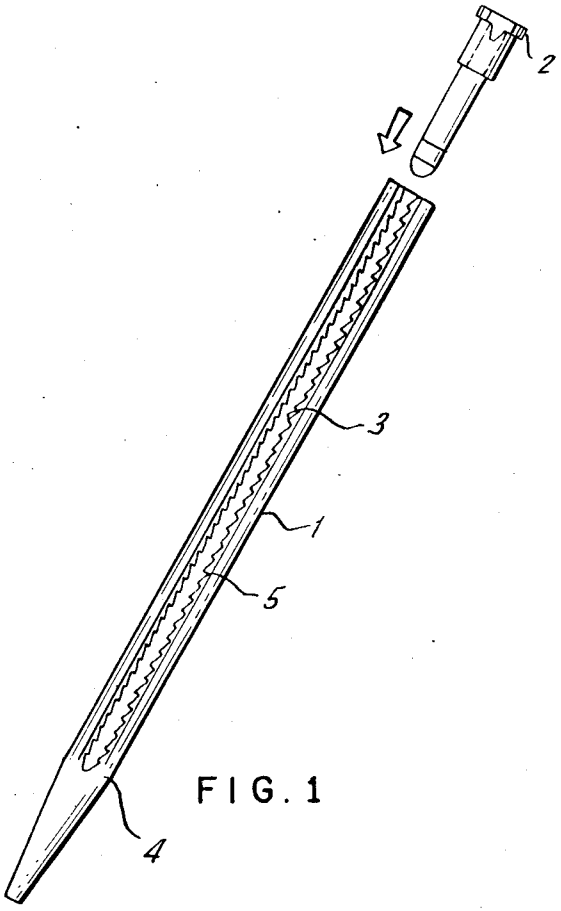
FIG. 1 is an exploded view of the body and the cap of the pencil holder, with the slitted groove visible.
Figure 7:
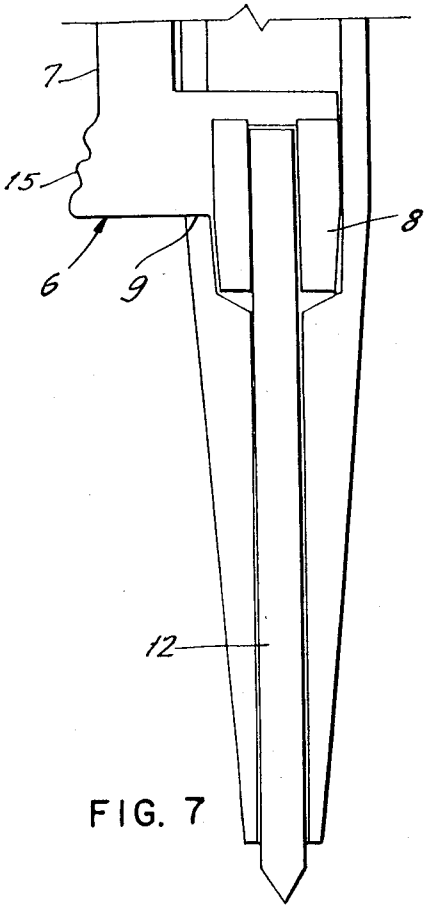
FIG. 7 is a lateral sectional view of the piston positioned at the lower end of the slit or at the tip of the pencil holder.
Figure 5:
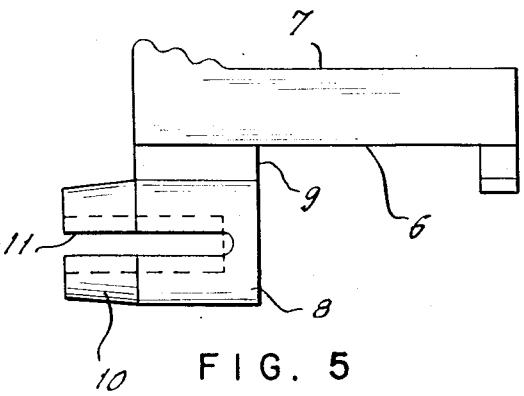
FIG. 5 is a view of the unit of piston and rod.
Figure 6:
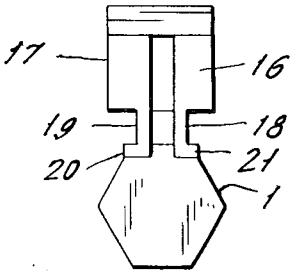
FIG. 6 is a view from above of the piston.
Figure 4:
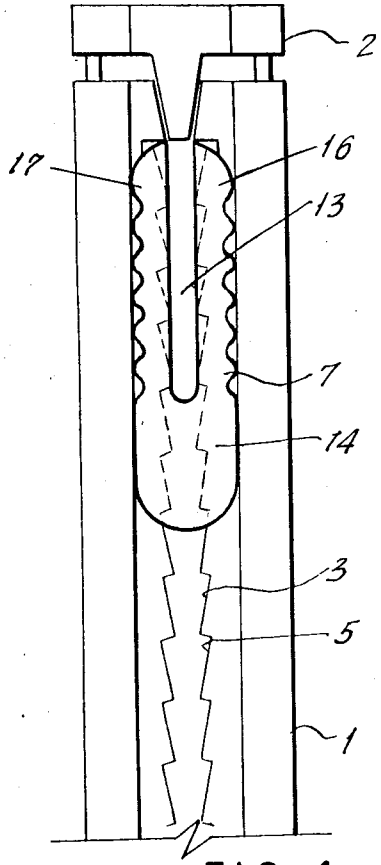
FIG. 4 is a front view of the position of the piston.

In these figures the same numbers correspond to the identical parts and the invention covers the pencil holder with the body or the case (1) of a preferibly polygonal format, which receives a cap with a holder (2) at the top, said body having on one of its sides a slit (3) which goes from the upper part to the lower part of the tip (4) this slit being grooved similar to a scale (5). The piston (6) similar to an "L" is formed of a rod (7) and a head (8) interconnected by an intermediary wall (9), the head having a projection underneath (10) and having in the middle an inside cavity (11) to receive the graphite (12). The rod (7) of the piston is of flexible material and has a slit (13) emerging from its upper end to a lower height that coincides approximately with the height of the head (8), establishing a base (14), such base having small protuberances (15) for support. The slit (13) of the rod causes the formation of two sides (16, 17) that receive, in turn, at their ends, two projections (18, 19) horizontally in relation to the rod, of a size large enough to enter inside the body of the pencil holder and establish small lateral extensions similar to an "L" (20,21).

As may be readily understood, the piston is placed in the body of the holder with its upper piece entering through the slit existing in the case, and the graphite is inserted into the head, with the piston rod limited in the mentioned slit through the crossbars (18, 19) which are set in the grooves existing in the mentioned slit, with the extensions (20, 21) of these crossbars limiting and holding the piston inside the body of the pencil holder. As the graphite is being consumed, or when it is desired to move the piston to a better position for the graphite, the user presses the piston (6) through the protuberances (15) making it slide in an up-and-down direction. To move the opposite way (down-up), the two sides (16, 17) of the rod are pressed firmly so that the two extensions or projections (18, 19) are positioned in the slit (3) in a manner to have it moved in said direction, and when the two sides are released, these sides return to their earlier state of open and the two extensions go to different positions in the mentioned grooves of the slit.

The invention, in fact, can allow for modifications, within the scope of the concept, such as slits that coincide with the crossbars of the rod can be arranged through the inside of the body of the rod, with only one slit existing for moving the piston.

We claim:

1. Pencil holder, comprising a body or case having in one of its sides a slit that extends from the upper part to the lower part of the tip of the body or case, said slit being grooved in a manner similar to a scale a piston having an "L"-shaped section extending into said slit, said piston consisting of a rod, a head interconnected by an intermediary wall, the head being located inside the body or case and having in the middle a cavity for receiving the graphite; said rod running parallel to the body along said slit; said rod also having in the middle thereof a slit causing the formation of two sides that receive at the top two projections, similar to crossbars that are arranged horizontally in relation to the rod and whose ends are separated to establish small lateral extensions in the form of an "L".

2. Pencil holder, in accordance with claim 1, wherein the rod is made of flexible material, whose sides, once pressed, release the lateral extensions and so permit moving the piston inside the case.

3. Pencil holder, in accordance with claim 1, wherein said head is provided with a projection underneath to receive the graphite.

* * * * *